US011078447B1

(12) United States Patent
Brandau

(10) Patent No.: US 11,078,447 B1
(45) Date of Patent: Aug. 3, 2021

(54) MULTI-PURPOSE SURFACE CLEANER

(71) Applicant: W. Curt Brandau, Conway, SC (US)

(72) Inventor: W. Curt Brandau, Conway, SC (US)

( * ) Notice: Subject to any disclaimer, the term of this patent is extended or adjusted under 35 U.S.C. 154(b) by 6 days.

(21) Appl. No.: 16/505,868

(22) Filed: Jul. 9, 2019

Related U.S. Application Data

(60) Provisional application No. 62/695,468, filed on Jul. 9, 2018.

(51) Int. Cl.

| | |
|---|---|
| ***C11D 3/10*** | (2006.01) |
| ***C11D 7/12*** | (2006.01) |
| ***C11D 3/04*** | (2006.01) |
| ***C11D 3/20*** | (2006.01) |
| ***C11D 11/00*** | (2006.01) |
| ***C11D 7/06*** | (2006.01) |

(52) U.S. Cl.
CPC ..... *C11D 7/12* (2013.01); *C11D 3/046* (2013.01); *C11D 3/10* (2013.01); *C11D 3/2093* (2013.01); *C11D 7/06* (2013.01); *C11D 11/0029* (2013.01); *C11D 11/0035* (2013.01)

(58) Field of Classification Search
CPC ..... C11D 3/3942
USPC ..... 510/375
See application file for complete search history.

(56) References Cited

U.S. PATENT DOCUMENTS

| | | | | |
|---|---|---|---|---|
| 2,498,343 | A * | 2/1950 | Rider | A61Q 11/02 510/100 |
| 4,115,293 | A * | 9/1978 | Schoenholz | A61K 8/02 252/188.1 |
| 2004/0005992 | A1* | 1/2004 | Ebberts | C11D 7/12 510/276 |
| 2004/0162227 | A1* | 8/2004 | Caruthers, Jr. | C11D 3/0052 510/276 |
| 2007/0287650 | A1* | 12/2007 | Garner | C11D 3/3942 510/245 |
| 2008/0314416 | A1* | 12/2008 | Reimann-Philipp | C11D 3/39 134/28 |
| 2015/0093425 | A1* | 4/2015 | Moore | C11D 3/3917 424/408 |

* cited by examiner

*Primary Examiner* — Gregory E Webb
(74) *Attorney, Agent, or Firm* — P. Jeff Martin; The Law Firm of P. Jeffrey Martin, LLC

(57) ABSTRACT

A multi-purpose surface cleaning solution includes sodium percarbonate having a chemical formula of 2Na2CO3.3H2O2 that may be selectively provided in a range of concentrations, from 0.001% through 99.997%. In an aqueous solution, sodium percarbonate decomposes and yields soda ash [Na2CO3] and hydrogen peroxide [H2O2], with additional decomposition of hydrogen peroxide to water [H2O] and diatomic oxygen [O2]. The combination of soda ash, hydrogen peroxide, and diatomic oxygen chemically weaken and release the bonds of the contaminants from the surface(s) to which the contaminants have become attached.

2 Claims, 5 Drawing Sheets

MULTI-PURPOSE SURFACE CLEANER

I. RELATED APPLICATIONS

This application claims priority to U.S. Provisional patent Application No. 62/695,468, filed on Jul. 9, 2018, the disclosure of which is hereby incorporated by reference in its entirety.

II. FIELD OF THE INVENTION

The present application discloses and describes a multi-purpose surface cleaner.

III. BACKGROUND

Many multi-purpose surface cleaning solutions have been created and commercially sold, including products sold under the MR. CLEAN®, CLOROX®, PURELL®, and SIMPLE GREEN® house marks, among the many companies in this commercial space. Such cleaning solutions purport to provide a variety of versatile applications and uses, including use at full-strength or in diluted concentrations, and for a variety of indoor and/or outdoor applications, and for use on a variety of materials, such as metal, concrete, and other hard and harsh surfaces, as well as more delicate interior surfaces such as countertops, stove tops, and the like. A specific concern with multi-purpose surface cleaning products is the relative weakness of the solutions and inability to remove stains and debris deposited to surfaces via heat and/or smoke production. Moreover, multi-purpose formulations are often heavily scented leaving an undesirable smell and/or "taste" residue.

For specific articles, such as smoking devices used for medicinal and/or recreational purposes, including pipes and/or vaporizers comprising glass, metal, or other durable surfaces, other cleaning solutions are presently offered. For example, Formula 420 and/or Orange Chronic are two commercially available products used for cleaning such articles.

Because the act of smoking medicinal and/or recreational marijuana results in the collection of residue and contaminants on the interior of the smoking apparatus (pipe and/or vaporizer). Agents such as Formula 420 and/or Orange Chronic comprise an alcohol or aqueous hydrogen peroxide solution with an aggregate such as pumice and/or rock salt but are less than optimal in removing such residue and contaminants.

Moreover, whether multi-purpose and/or specific to contaminant removal, the aforementioned agents suffer from the inability to effectively clean and/or remove residue and contaminants from multiple delicate surfaces.

Accordingly, there is a need for an improved multi-purpose surface cleaner, and for an improved pipe and/or vaporizer cleaning solution to remove stubborn stains and debris.

IV. BRIEF DESCRIPTION OF THE DRAWINGS

V. DESCRIPTION OF THE EMBODIMENT(S)

According to one embodiment, a multi-purpose surface cleaning solution comprises a surface cleaning composition comprising sodium percarbonate having a chemical formula of $2Na_2CO_3.3H_2O_2$ that may be selectively provided in a range of concentrations, from 0.001% through 99.997%. Percarbonate may be provided with or without a coating, the coating comprising a surfactant that prevents or inhibits contact between the percarbonate material and additional materials added thereafter. In an aqueous solution, sodium percarbonate decomposes and yields soda ash [$Na_2CO_3$] and hydrogen peroxide [$H_2O_2$], with additional decomposition of hydrogen peroxide to water [$H_2O$] and diatomic oxygen [$O_2$]. The combination of soda ash, hydrogen peroxide, and diatomic oxygen chemically weaken and release the bonds of the contaminants from the surface(s) to which the contaminants have become attached. The chemical weakening of the bonds of the contaminants result in the removal of the contaminants from the targeted surface (s).

In one application of the aforementioned embodiment, the cleaning solution may be applied to the interior surface(s) of a pipe and/or vaporizer used for smoking medical and/or recreational marijuana. Through the decomposition noted above, and the release of the bonds between contaminant(s) and surface(s), the contaminant residue is released and removed from the surface(s). The application of the cleaning solution is suitable for use with a plurality of materials, including but not limited to glass, porcelain, ceramic, plastic (s), thermoplastic(s), polyvinyl chloride (PVC), acrylic, a variety of metals and/or metal alloys, woods, compositions, and combinations thereof.

Figure 1:
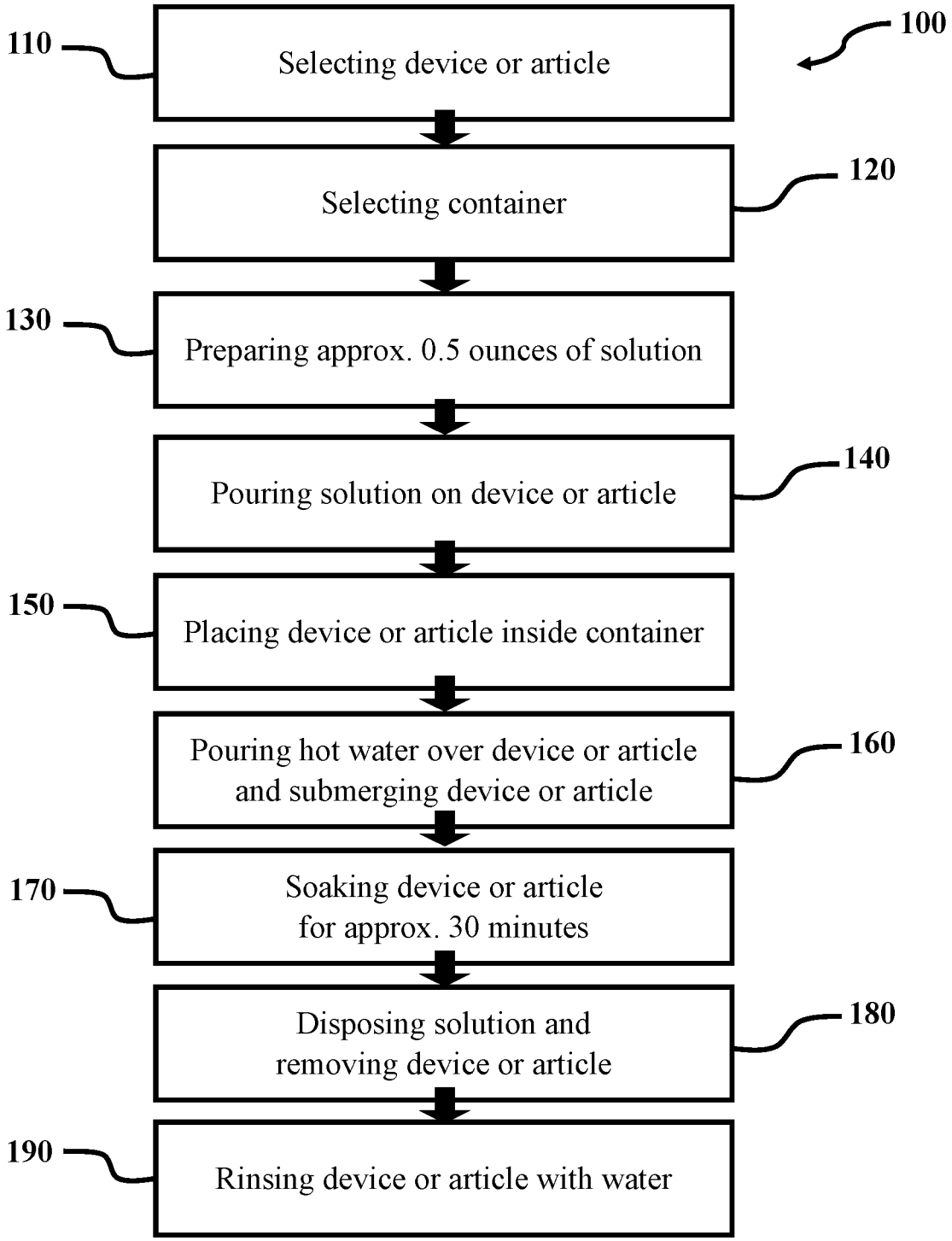
FIG. 1 is a schematic of the steps regarding an embodiment utilizing a multi-purpose surface cleaning solution as described herein.
Figure 2:
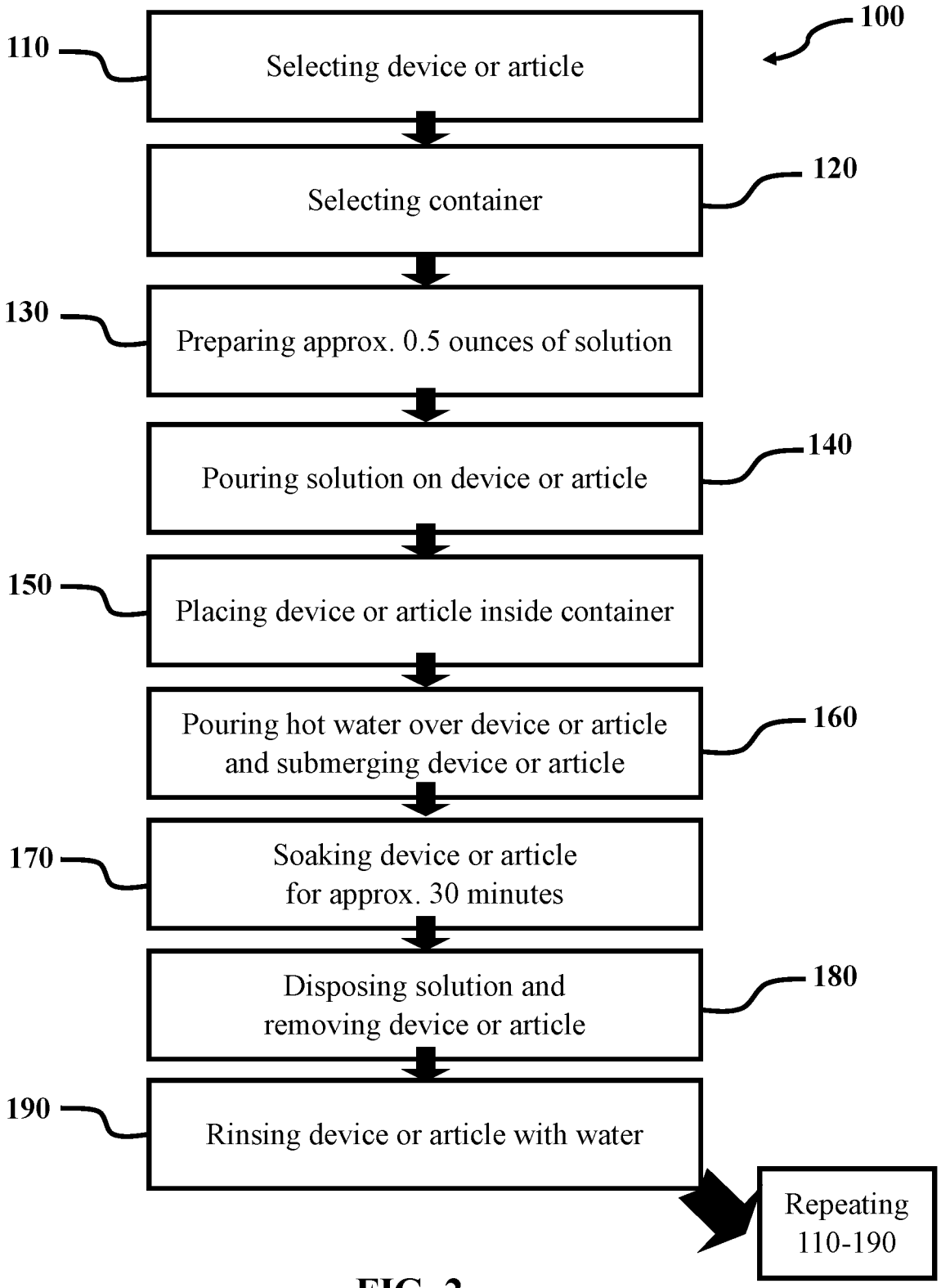
FIG. 2 is a schematic of another embodiment of the steps utilizing a multi-purpose surface cleaning solution.

In specific application of the aforementioned embodiment, consistent with FIG. 1, a method for using the cleaning solution above 100 includes the steps of the user identifying the device or article to be cleaned 110 and additionally identify a container 120 large enough that allows the device or article to be submerged therein. After selecting the device or article and a sufficiently large container, the user will prepare 130 one-half (0.5) ounce (or 14 grams by weight) of the cleaning composition that will be poured 140 over the device or article. Thereafter, the device or article will be placed 150 inside the container and hot water (including up to boiling water) will be poured 160 over the device or article and submerging the device or article within the container until fully covered. The device or article will soak 170 for approximately 30 minutes in this submerged state. After 30 minutes, the container solution may be dumped 180 and the device or article may be rinsed 190 under running water, which will carry the loosened contaminant or residue material from the device or article. In the event of particularly stubborn or difficult stains and/or residue contaminant material, and consistent with FIG. 2, multiple treatments consistent with the steps above may be necessary.

Figure 3:
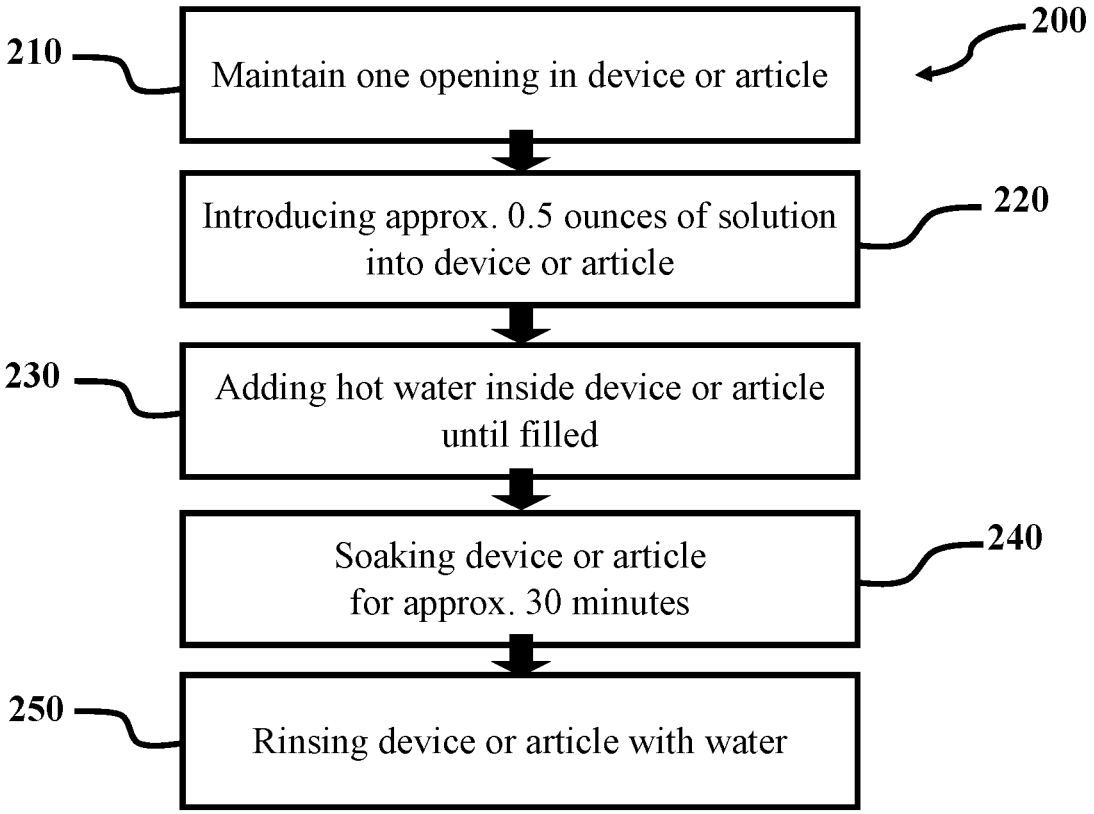
FIG. 3 is a schematic of another embodiment of the steps utilizing a multi-purpose surface cleaning solution.
Figure 4:
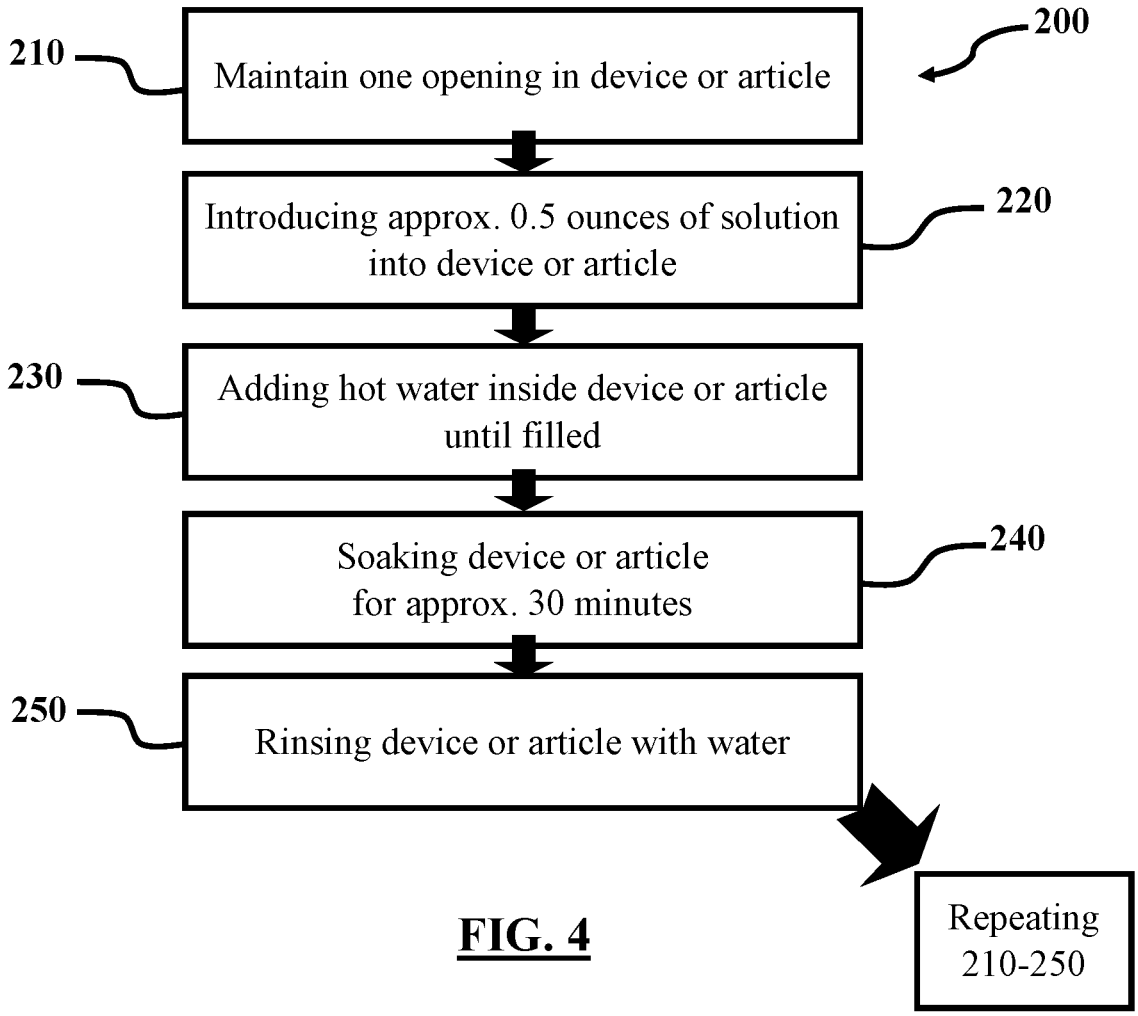
FIG. 4 is a schematic of another embodiment of the steps utilizing a multi-purpose surface cleaning solution.

For use with water pipes and/or other large devices, and consistent with FIG. 3, in another method of using the solution above 200, the user will want to plug or close any openings or holes except for one opening/hole 210. Thereafter, introduce 220 approximately 0.5 ounces (or 14 grams by weight) of the cleaning product into the device. Next, slowly add hot and/or boiling water inside of the device 230 until the article or device is filled with water. Allow the device or article to soak 240 for approximately 30 minutes, and then rinse 250 with running water to remove loosened debris or residue. In the event of particularly stubborn or difficult stains and/or residue contaminant material, and consistent with FIG. 4, multiple treatments consistent with the steps above may be necessary.

Figure 5:
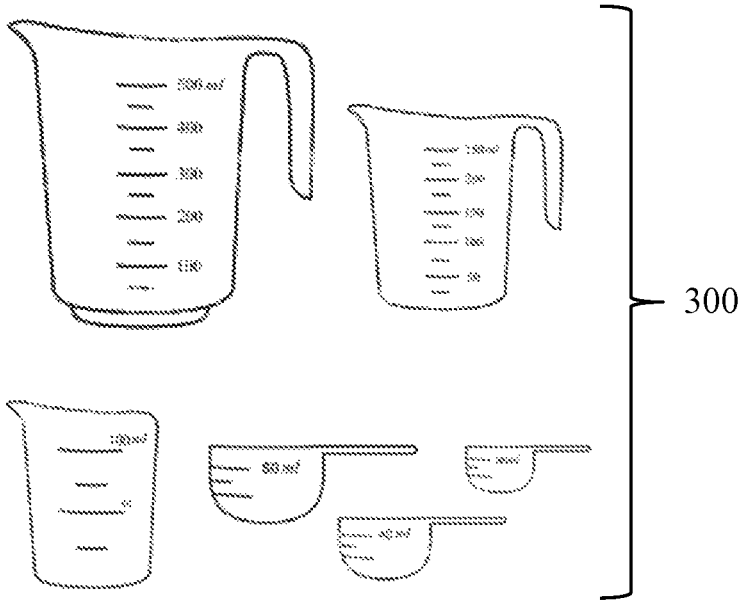
FIG. 5 is an illustration of a plurality of measuring devices for utilization with the embodiment or embodiments of the steps utilizing a multi-purpose surface cleaning solution.

It is also envisioned that a kit may be utilized, the kit comprising the cleaning solution (composition), consistent with FIG. 5, and further including at least on cleaning solution measuring device, the at least one measuring device 300, such as a spoon-type device, sized to hold an exact amount of cleaning solution (in powder form) for standard size smoking device or article (e.g., pipe and/or vaporizer), or a plurality of measuring devices, or other types of measuring devices with visual indicators or other means by which proper cleaning solution amount can be used for a corresponding pipe. The kit may also include a large container suitably sized to accommodate the cleaning solution and which allows the pipe to lie in a submerged fashion therein. Moreover, the kit may include a drying rack for supporting the cleaned pipe to facilitate drying thereof.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A method of removing residue and contaminants from an interior of a smoking pipe article, the steps comprising:

closing openings or holes in the article except for one opening or hole;

introducing approximately 0.5 ounces (14 grams by weight) of a surface cleaning solution into the article, the surface cleaning solution comprising sodium percarbonate ($2Na_2CO_3.3H_2O_2$), the sodium percarbonate dissolved in a solvent producing an aqueous solution promoting decomposition of the sodium percarbonate yielding soda ash ($Na_2CO_3$) and hydrogen peroxide ($H_2O_2$);

adding boiling water inside of the article until the article is filled with the water;

soaking the article for approximately 30 minutes; and rinsing the article with running water to remove loosened debris or residue.

2. The steps of claim 1 further comprising repeating the steps to remove any remaining contaminant or residue from the article.

* * * * *